United States Patent [19]

Becker

[11] Patent Number: 5,069,126

[45] Date of Patent: Dec. 3, 1991

[54] ELECTRICAL CIRCUIT-BREAKING DEVICE FOR PROTECTING A CLAMPING DEVICE OF A SHEET-GUIDING DRUM OF A PRINTING MACHINE

[75] Inventor: Willi Becker, Bammental, Fed. Rep. of Germany

[73] Assignee: Heidelberger Druckmaschinen Ag, Heidelberg, Fed. Rep. of Germany

[21] Appl. No.: 465,804

[22] Filed: Jan. 16, 1990

[30] Foreign Application Priority Data

Jan. 13, 1989 [DE] Fed. Rep. of Germany ..... 3900820

[51] Int. Cl.[5] ..... B41F 5/04

[52] U.S. Cl. ..... 101/230; 101/246

[58] Field of Search ..... 101/230, 174, 231, 232, 101/409, 410, 229, 222, 223, 246; 192/70.23

[56] References Cited

U.S. PATENT DOCUMENTS

| | | | |
|---|---|---|---|
| 3,952,843 | 4/1976 | Campbell et al. | 192/70.23 |
| 4,138,006 | 2/1979 | Benson, Jr. | 192/70.23 |
| 4,457,231 | 7/1984 | Kawaguchi | 101/230 |
| 4,580,494 | 4/1986 | Becker | 101/230 |
| 4,716,827 | 1/1988 | Wieland et al. | 101/230 |
| 4,735,140 | 4/1988 | Wieland et al. | 101/230 |
| 4,831,929 | 5/1989 | Sato | 101/230 |
| 4,924,988 | 5/1990 | Page | 192/70.23 |

FOREIGN PATENT DOCUMENTS

| | | | |
|---|---|---|---|
| 0216045 | 4/1987 | European Pat. Off. | 101/230 |
| 0216046 | 4/1987 | European Pat. Off. | 101/230 |
| 0005715 | 4/1979 | Fed. Rep. of Germany | 101/230 |
| 3611325 | 10/1987 | Fed. Rep. of Germany | 101/230 |
| 0071162 | 4/1983 | Japan | 101/230 |
| 2142908 | 1/1985 | United Kingdom | 101/230 |

*Primary Examiner*—Edgar S. Burr
*Assistant Examiner*—John S. Hilten
*Attorney, Agent, or Firm*—Herbert L. Lerner; Laurence A. Greenberg

[57] ABSTRACT

An electrical circuit-breaking device for protecting a clamping device of a sheet-guiding drum of a printing machine, wherein the clamping device has an actuating member formed with a thread and being turningly screwable therewith in axial direction over a first travel phase and a second travel phase between end positions, includes a switching member for an electrical switch connected in a power-supply circuit for driving the printing machine, the switching member being actuatable in the first travel phase of the actuating member, a device defining at least one friction surface on the sheet-guiding drum and at least one friction surface of a drum part adjustable on the drum in circumferential direction thereof, intermediate members for pressing the friction surfaces against one another, the intermediate members being actuatable in the second travel phase of the actuating member, a stop device effective in turning direction of the actuating member including a cam on the actuating member, and two cams on a machine part fixed against rotation, the two cams fixed against rotation being assigned, respectively, to each of the end positions and being spaced from one another in the axial direction of the actuating member a distance greater than a thread pitch of the thread formed in the actuating member, the cam on the actuating member having an area overlapping at the respective end positions with a respective area of each of the two cams on the machine part, the mutually overlapping areas being smaller in the axial direction then the thread pitch.

7 Claims, 4 Drawing Sheets

ELECTRICAL CIRCUIT-BREAKING DEVICE FOR PROTECTING A CLAMPING DEVICE OF A SHEET-GUIDING DRUM OF A PRINTING MACHINE

The invention relates to an electrical circuit-breaking device for protecting a clamping device of a sheet-guiding drum of a printing machine and, more particularly, wherein the clamping device has an actuating member formed with a thread and axially screwable between end positions.

Such an electrical circuit-breaking protection device has become known heretofore from German Published Non-Prosecuted Application (DE-OS) 36 11 325 in relation to a turning drum of a printing machine for perfector printing. With respect thereto, an actuating element can be screwed by means of an inner thread onto an outer thread of a tension rod, which has a flange-like enlargement by means of which it acts upon clamping levers of a clamping device so as to lock a crown gear to a gear wheel of the turning drum, the tension rod being loaded or stressed permanently in the direction of clamping by a spring, from which the clamping forces emanate and against the action of which the clamping device can be released. For this purpose, the actuating element is screwed onto the thread of the tension rod and initially moves in a first phase along an idle path, thereby actuating a switching element for an electrical switch which is connected in a power-supply circuit for the drive of the printing machine. This is effected by means of a rocker bearing for the switching element, one end of which engages in a circumferential groove formed in the axially displaceable actuating element, and the other end of which acts upon the electrical switch. The instant the switch has interrupted the circuit, the actuating element comes to rest against the end face of a sleeve which encases the tension rod in a manner that it is capable of axial movement, so that the tension rod is drawn through the sleeve as the actuating element is screwed on further, and the spring is thereby compressed so that it releases the pressure on the clamping levers. A screwing movement of the actuating element in the opposite direction results initially in partial stress-relieving of the spring, so that the spring returns the clamping device to the active functioning mode thereof until the electrical switch in the circuit of the machine drive is closed again as the further screwing action progresses to the idle path region in which there is no action on the clamping device. The end positions of the movement of the actuating element are not exactly defined, because a so-called "keying-on" or "wedging-on" effect occurs due to the screw thread.

It is accordingly an object of the invention to provide an improvement in an electrical circuit-breaking device of this general type for protecting a clamping device wherein the end positions are precisely defined by stops effective in the direction of rotation, and wherein it is possible for an actuating member to perform a movement of more than 360 degrees between the stop positions.

With the foregoing and other objects in view, there is provided, in accordance with the invention, an electrical circuit-breaking device for protecting a clamping device of a sheet-guiding drum of a printing machine, the clamping device having an actuating member formed with a thread and being turningly screwable therewith in axial direction over a first travel phase and a second travel phase between end positions, the circuit breaking device comprising a switching member for an electrical switch connected in a power-supply circuit for driving the printing machine, the switching member being (enabled) actuatable in the first travel phase of the actuating member, means defining at least one friction surface on the sheet-guiding drum and at least one friction surface of a drum part adjustable on the drum in circumferential direction thereof, intermediate members for pressing the friction surfaces against one another, the intermediate members being actuatable in the second travel phase of the actuating member, stop means effective in turning direction of the actuating member including a cam on the actuating member, and two cams on a machine part fixed against rotation, the two cams fixed against rotation being assigned, respectively, to each of the end positions and being spaced from one another in the axial direction of the actuating member a distance greater than a thread pitch of the thread formed in the actuating member, the cam on the actuating member having an area overlapping at the respective end positions with a respective area of each of the two cams on the machine part, the mutually overlapping areas being smaller in the axial direction than the thread pitch.

In accordance with another feature of the invention, an idle path is traversed by the actuating member in the first travel phase thereof, the idle path preceding actuation of the switching element and being defined by the spaced distance between the two cams fixed against rotation, and dependent upon the thread pitch.

In accordance with a further feature of the invention, there is provided a tension rod formed with a thread whereon the actuating member is screwable, the tension rod being mounted so as to be axially displaceable in the sheet-guiding drum and being spring-loaded in the clamping direction and secured against torsion, the tension rod being applicable on the intermediate members for transmitting spring tension during the second travel phase of the actuating member, the stop cam fixed against rotation at one of the end positions and associated with the released clamping device being disposed so as to be displaceable parallel to the tension rod, and being displaceable into an operating position thereof by the tension rod at an end of an axial displacement thereof against the spring loading in the clamping direction. These features should be particularly emphasized, in that the tension rod can be moved axially along a path of any desired length by turning the actuating member without any hindrance or impedance by any stop. The stop is shifted into its active functioning position only towards the end of the axial movement, and it is immediately withdrawn from this position when the actuating member is turned in the opposite direction.

In accordance with an additional feature of the invention there is provided an annular flange mounted on the tension rod, and including a substantially bell-shaped housing secured to an end face of the sheet-guiding drum, a bolt protruding into the substantially bell-shaped housing and carrying the two cams fixed against rotation at an outer end thereof, the bolt having an inner end braced under spring-bias axially against the annular flange of the tension rod.

In accordance with an added feature of the invention, there is provided a structural unit preassemblable in the clamping device of the sheet-guiding drum and comprising the substantially bell-shaped housing and the tension rod spring-loaded in the clamping direction disposed in the substantially bell-shaped housing, the actuating member and the stop cams associated therewith, and the switching member for the electrical switch; and screw means for securing the structural unit to a front surface of a shaft whereon the sheet-guiding drum is mounted.

In accordance with a further feature of the invention, there is provided an axial roller bearing mounted in an end face of the substantially bell-shaped housing, the actuating member, in the second travel phase thereof, being braced against the axial roller bearing.

In accordance with a concomitant feature of the invention, the screw means include at least one screw passing loosely through a recess formed in the annular flange of the tension rod so as to secure the tension rod against rotation.

Other features which are considered as characteristic for the invention are set forth in the appended claims.

Although the invention is illustrated and described herein as embodied in an electrical circuit-breaking device for protecting a clamping device of a sheet-guiding drum of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
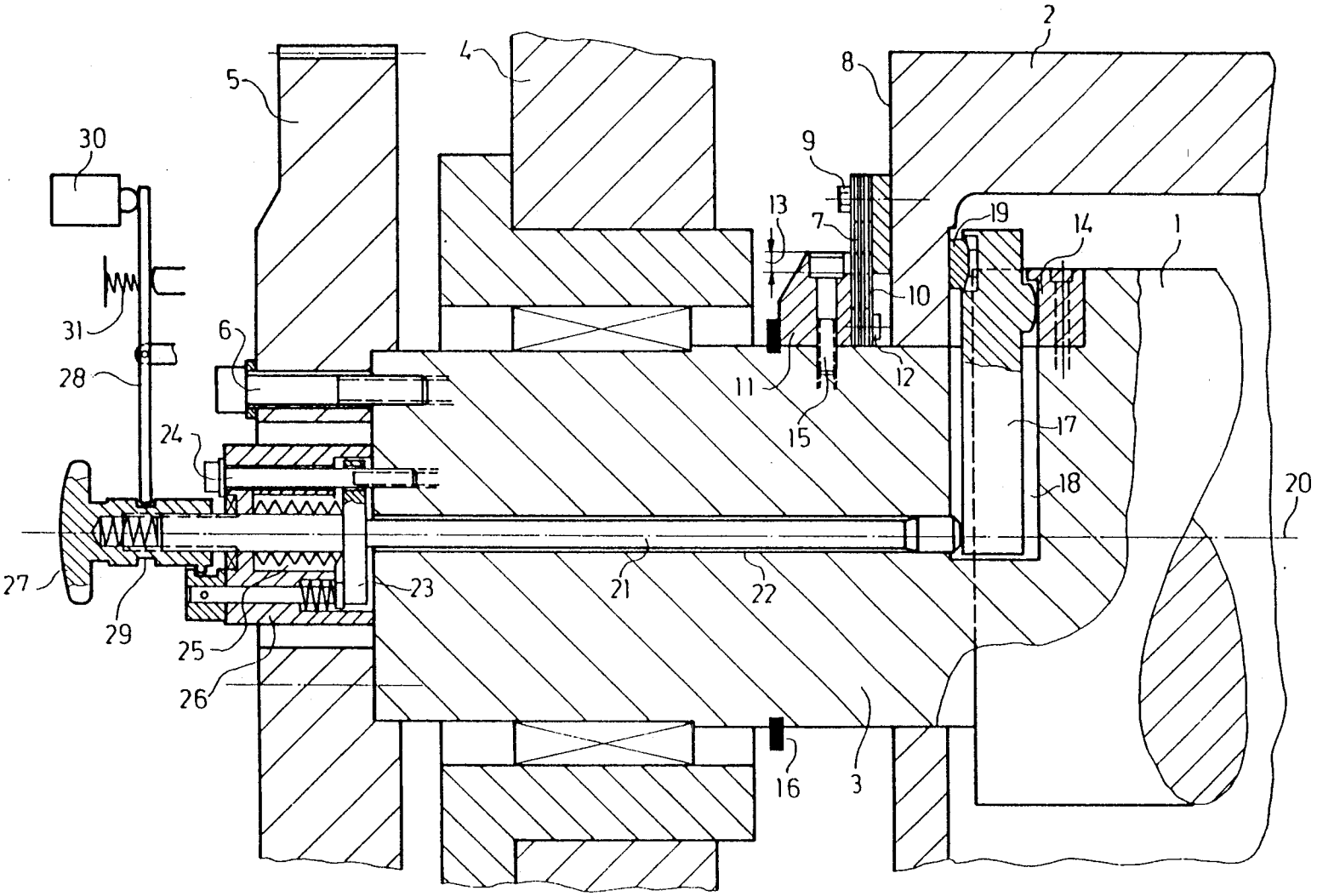
FIG. 1 is an axial sectional view of an end of a sheet guiding drum and its bearing, and the electrical circuit-breaking device for protecting a clamping device thereof, in accordance with the invention.

Referring now to the drawing and first, particularly, to FIG. 1 thereof, there is shown therein an embodiment of an electrical circuit-breaking device for protecting a clamping device of a sheet guiding drum with an internal shaft 1 of solid material and external drum parts with at least one segment which is adjustable with respect to the internal shaft 1 in circumferential direction thereof. Instead of the illustrated embodiment with a continuous internal shaft, a construction with a drum body, and a pin or journal integrally cast thereon for the bearing of the drum can also be provided, so that the construction described hereinafter can be disposed in such a pin or journal.

Figure 2:
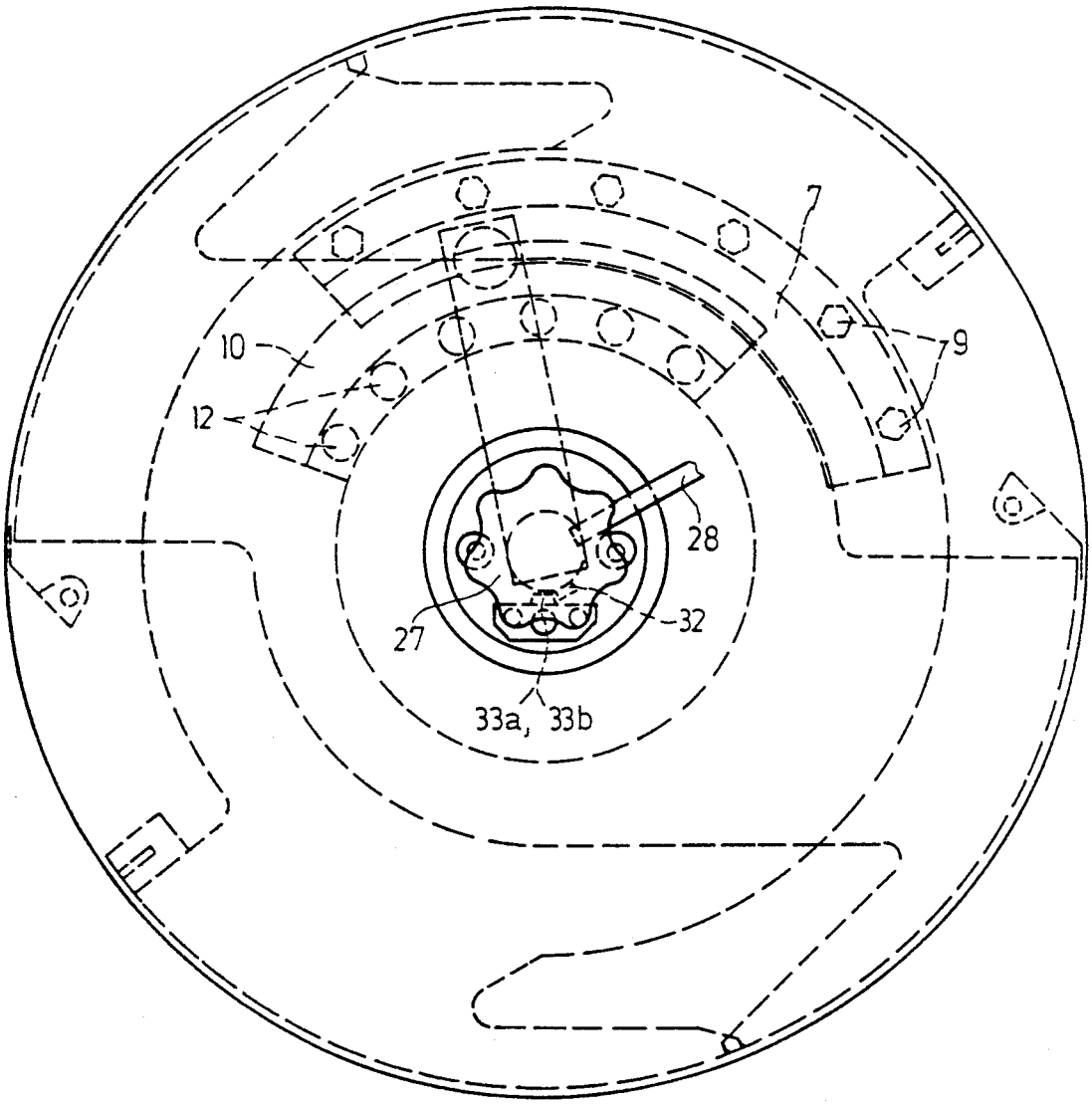
FIG. 2 is a side elevational view of FIG. 1.

A sheet feeding surface is formed on the outer cylindrical surface of the segment 2. In addition, suction nozzles or other sheet smoothing and gripping devices, respectively, may be provided. The segment 2 can be firmly locked with the internal shaft 1 by means of a clamping device. The internal shaft 1 is supported at both ends thereof in lateral walls 4 of the machine frame by means of journals 3 which are formed of solid material and are integral with the shaft 1. The internal shaft 1 is drivable by a gear wheel 5, which is connected, outside the machine frame, to an end face of the shaft 1 by means of several screws 6 located at variously distributed positions. To provide a reliable, frictionally secured interlocking of the shaft 1 and the segments 2 disposed in the external drum, several friction members 7, like in a type of disk clutch, are fixed as a package (for example by means of screws 9) at a spaced distance from one another, to a surface 8 of the segment 2, the surface 8 extending radially and as close as possible to the lateral wall 4. A complementary formed package of friction members 10 is also fixed (for example by means of screws 12) to a likewise radially extending surface, of a counter-bearing 11 which is connected, however, to the journal 3 or directly to the shaft 1, the friction members 7 having intermediate laminations of equal thickness, and the friction members 10 which are also formed of such intermediate laminations meshing together and overlapping within a given region 13. In this overlap region 13, the friction members 7 fixed to the segment 2, and the friction members 10 fixed to the counter-bearing 11 can be axially braced against one another between the counter-bearing 11 and a second counter-bearing 14 on the shaft 1, so that high frictional forces are created due to the increase in the friction surfaces between the friction members 7 and 10, even though the clamping force for bracing is relatively small. In the illustrated embodiment of FIG. 1, three friction members, respectively, are in one package so that seven friction surfaces exist in the overlap region 13. In order to match the friction members 7 and 10 to the shape of the segment 2, the friction members 7 and 10 are also segment-shaped so that, from a side view, they only extend over a part of the circumference, as can be seen from FIG. 2. In the illustrated embodiment of FIG. 1, the counter-bearing 11 is formed by a ring segment, which is fastened by means of screws 15 to the journal 3 of the shaft 1 and, in addition, is braced axially against a support ring 16 or the like.

The clamping device has a clamping lever 17, which is disposed in a lateral recess 18 formed in the shaft 1, and is effective therein as a rocker with lever arms of unequal length. The clamping lever 17 is braced, in the vicinity of a radially outer end thereof against the counter-bearing 14 and, by means of a pressure block 19, exerts pressure in the overlap region 13 against the inner side of the radial part of the segment 2 which is located opposite to the surface 8, so that the pressure forces act parallel to the longitudinal axis 20 of the shaft 1. A surface at an end of a tension rod 21, which is permanently spring-loaded in the direction of clamping, presses the other end of the clamping lever 17 in the direction of the shaft axis 20. The tension rod 21 is disposed centrally or eccentrically in a recess or bore 22 formed in the journal 3 and extending parallel to the shaft axis 20, the other end of the tension rod 21 protruding from the face of the journal 3 of the shaft 1. Outside the journal 3, the tension rod 21 is formed with an annular flange 23, which is penetrated by a screw 24 in at least one location thereof for securing the tension rod 21 against torsion without impeding any axial displacement thereof.

A spring set or package 25, for example of cup or plate springs, is disposed outside the annular flange 23 and is braced, at one side thereof, against the annular flange 23 and at the other side thereof, against the inner side of a substantially bell-shaped housing 26, which is firmly fastened to the end face of the journal 3 by the screw 24 and other non-illustrated screws. For this purpose, the gear wheel 5 is formed with a central recess which permits the bell-shaped housing 26 to extend therethrough. The tension rod 21 is constantly pressed against the radially inner end of the clamping lever 17 by the spring package 25, so that the resilient forces are multiplied by means of this clamping lever 17, and are transmitted to the friction surfaces of the friction members 7 and 10. As a result, the clamping force between the friction members 7 and 10 is exclusively dependent upon the elastic force of the spring 15, and not on auxiliary forces. The free end of the tension rod 21 protrudes through the base of the bell-like housing 26 to the outside, and connected there to an actuating member 27. In the illustrated embodiment, a thread is provided on the outer end of the tension rod 21, and an inner thread of the actuating member 27 is screwable thereon; the resulting assembly cooperates with an electrical circuit-breaking mechanism for protecting the clamping device. For this purpose, the actuating member 27, starting from the clamping position, is screwed onto the thread of the tension rod 21, initially along an idle path which is set for actuating the electrical circuit-breaking protection mechanism. By way of example, a switching element 28 is shown, which is in the form of a rocker arm firmly mounted on the machine, one end of the rocking arm 28 engaging in a circumferential recess 29 formed on the actuating member 27, while the other end of the rocking arm 28 acts against an electrical switch 30, a spring 31 being provided which exerts pressure on the switching element 28 in the direction of the starting position thereof prior and opposite to its movement towards the switch 30. Only after passing through the idle path, does the actuating member 27 come to rest against an axial roller bearing 36 (FIG. 4) at the outside of the bell-shaped housing 26, so that, as the actuating member 27 continues to be screwed on, the tension rod 21 is axially shifted towards the left-hand side in the projection plane of FIG. 1. The pressure on the clamping lever 17 is thereby relieved, so that the frictionally locked connection between the friction members 7 and 10 is released. When the actuating member 27 is turned in the opposite direction, the spring set 25 initially presses the tension rod 21 against the inner end of the clamping lever 17 with the force of the spring set 25, so that the frictionally locked connection between the friction members 7 and 10 is restored, before the actuating member 27 can be turned back to the starting position on the idle path, whereby it again releases the switch 30 for providing the electrical circuit-breaking protection of the clamping device, via the switching element 28.

Figure 3:
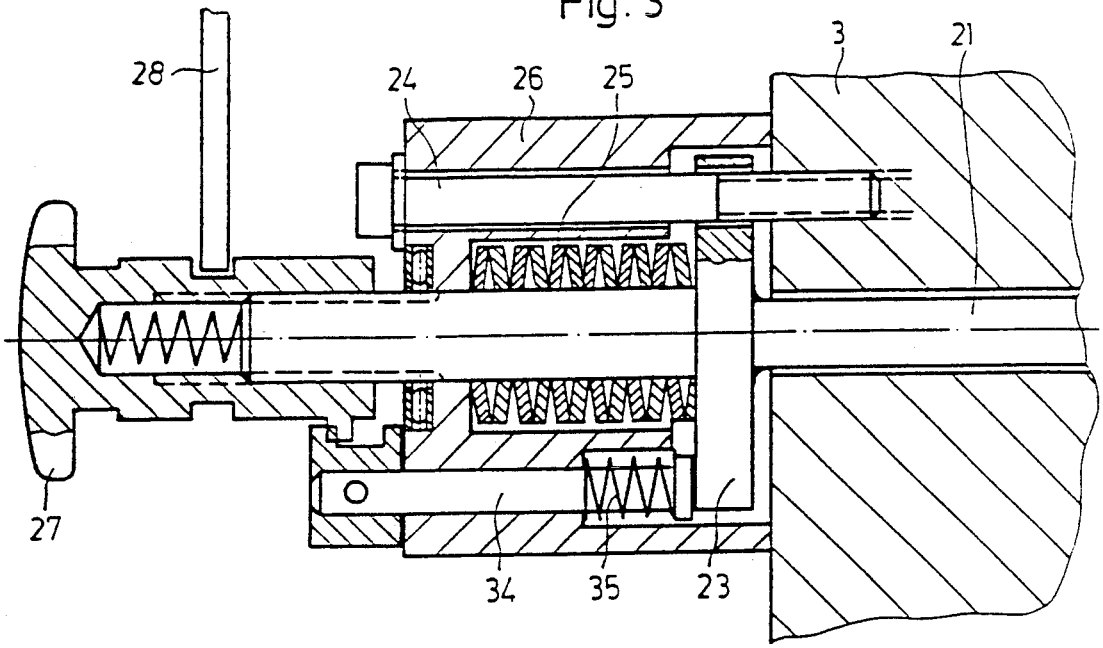
FIG. 3 is an enlarged fragmentary view of FIG. 1, showing the operating mechanism of the circuit-breaking device, with the clamping device in closed position.
Figure 4:
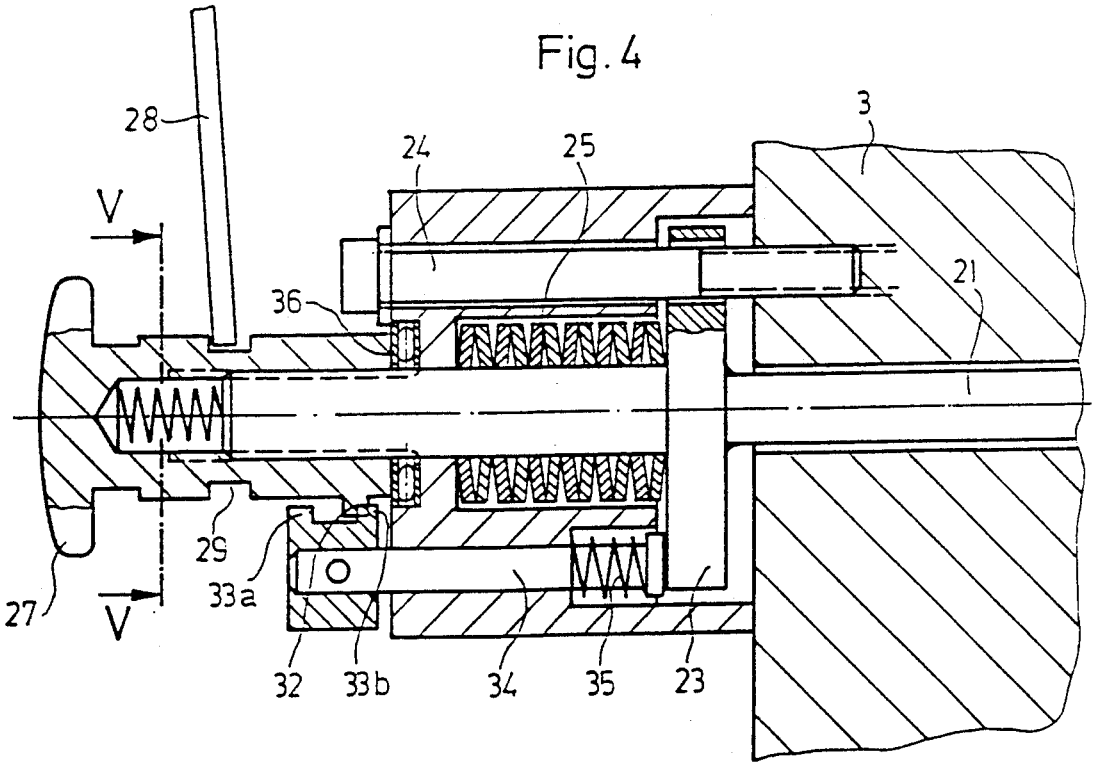
FIG. 4 is a view similar to that of FIG. 3, showing the operating mechanism in another operating phase thereof, the clamping device being in open position.
Figure 5:
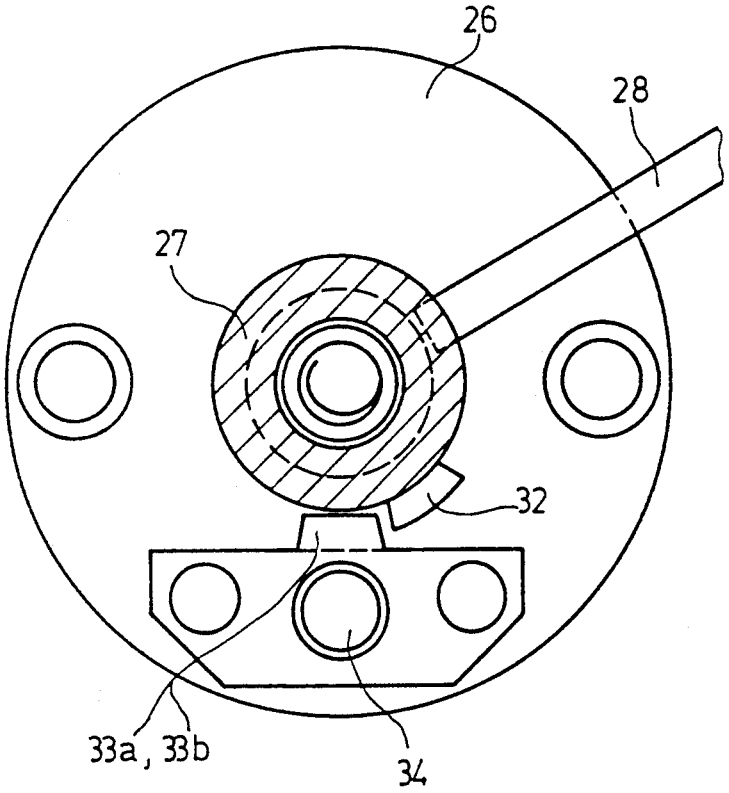
FIG. 5 is a cross-sectional view of FIG. 4 taken along the line V—V in the direction of the arrows.

The end positions for the movement of the actuating member 27 are limited by respective stops 32 and 33*a* and 33*b* (FIGS. 2 and 4) which are constructed so that they also define the idle path for switching the electrical circuit-breaking protection mechanism. For this purpose, provision is made that, at the end of the axial movement of the tension rod 21, the latter moves the stop 33*b*, which limits the turning movement when the clamping device is released, so that the stop 33*b* is in its active position. Furthermore, the axial overlap of the radially operating stop 32 with the stops 33*a* and 33*b*, respectively, in the stop positions is smaller than the pitch of the thread on the free end of the tension rod 21 and in the actuating member 27, respectively. Provision is made for one stop 32 to be formed of a cam on the actuating member 27, this cam stop 32 having two stop surfaces, one of which, respectively, is active in each direction of revolution; and provision is also made for counter-stops 33*a* and 33*b* on machine parts which are fixed against rotation, the counter-stops 33*a* and 33*b* being positioned in the axial direction of the tension rod 21 and the shaft 1, respectively, at a spaced distance from one another which corresponds to the length of the idle path, the counterstops 33*a* and 33*b* being axially displaceable on an outer end of a bolt 34 which is axially movable in the substantially bell-shaped housing 26, and has an inner end which is braced against the annular flange 23 of the tension rod 21. Due to the fact that the overlap between the stop 32 and the stops 33*a* and 33*b*, respectively, is smaller than the thread pitch and, due to the axial spacing between the two latter stops 33*a* and 33*b*, the stop 32 on the actuating member 27 can perform several revolutions of the actuating member 27 in order to provide an idle path of sufficient length for actuating the electrical circuit-breaking protection mechanism, and the stop 32 may be turned further in order to enable an axial displacement of the tension rod 21 against the action of the spring set 25 so as to release the clamping device, before the stop 32 comes to rest against the stop 33*b* in the end position when the clamping device is released. For this purpose, the stop 33*b* is subjected to a slight axial displacement by the bolt 34, starting from the axial movement of the tension rod 21, so that the stop 33*b* engages in or intersects the turning circle of the stop 32. During the first revolution of the actuating member 27 in the opposite direction, the tension rod 21 moves to the right-hand side, as viewed in FIG. 1, for example, so that the stop 33*b*, reinforced or supported by the spring 35, also moves to the right-hand side, so as to rest against the substantially bell-shaped housing 26, and is no longer in the way of or blocks the stop 32 during the next revolution of the actuating member 27. Only after the idle path has been traversed, does the stop 32 again come to rest against the stop 33*a*, as shown in FIG. 3, so that the other end position of the actuating member 27 is thereby delimited. As is readily apparent, FIG. 4 shows the contact between the stops 32 and 33*b* when the clamping device is released.

Instead of the manually turnable actuating member 27, as described hereinbefore, a motorized actuating member for the tension rod 21 can be provided.

The foregoing is a description corresponding in substance to German Application P 39 00 820..7, dated Jan. 13, 1989, the International priority of which is being claimed for the instant application, and which is hereby made part of this application. Any material discrepancies between the foregoing specification and the aforementioned corresponding German application are to be resolved in favor of the latter.

What is claimed is:

1. Electrical circuit-breaking device for protecting a clamping device of a sheet-guiding drum of a printing machine having a machine part fixed against rotation, the clamping device having an actuating member formed with a thread and being turningly screwable therewith in a first travel phase and in a second travel phase over a given distance in axial direction between respective end positions, the circuit breaking device comprising a switching member for an electrical switch connected in a power-supply circuit for driving the printing machine, said switching member being actuatable in the first travel phase of the actuating member, the sheet-guiding drum having a drum part adjustable thereon in circumferential direction thereof, means defining at least one friction surface on the sheet-guiding drum and at least one friction surface on said drum part, intermediate members for pressing said friction surfaces against one another, said intermediate members being actuatable in the second travel phase of the actuating member, stop means effective in turning direction of the actuating member including a cam on the actuating member, and a pair of cams mounted on said machine part fixed against rotation, said pair of cams, respectively, defining each of the end positions and being spaced from one another in the axial direction of the actuating member a distance greater than a thread pitch of the thread formed in the actuating member, said cam on the actuating member having an area overlapping at the respective end positions with a respective area of each cam of said pair of cams on the machine part fixed against rotation, the mutually overlapping areas being smaller in the axial direction than said thread pitch.

2. Electrical circuit-breaking device according to claim 1 wherein an idle path is traversed by the actuating member in the first travel phase thereof, said idle path preceding actuation of said switching element and being defined by said spaced distance between said two cams fixed against rotation, and dependent upon the thread pitch.

3. Electrical circuit-breaking device according to claim 1, including a tension rod formed with a thread whereon the actuating member is screwable, said tension rod being mounted so as to be axially displaceable in the sheet-guiding drum and being spring-loaded in the clamping direction and secured against torsion, said tension rod being applicable on said intermediate members for transmitting spring tension during the second travel phase of the actuating member, said stop cam fixed against rotation at one of said end positions and associated with the released clamping device being disposed so as to be displaceable parallel to said tension rod, and being displaceable into an operating position thereof by said tension rod at an end of an axial displacement thereof against the spring loading in the clamping direction.

4. Electrical circuit-breaking device according to claim 3 including an annular flange mounted on said tension rod, and including a substantially bell-shaped housing secured to an end face of the sheet-guiding drum, a bolt protruding into said substantially bell-shaped housing and carrying said two cams fixed against rotation at an outer end thereof, said bolt having an inner end braced under spring-bias axially against said annular flange of said tension rod.

5. Electrical circuit-breaking device according to claim 4, including a structural unit disposed in the clamping device of the sheet-guiding drum and comprising said substantially bell-shaped housing, said tension rod spring-loaded in the clamping direction disposed in said substantially bell-shaped housing, the actuating member and said stop cams associated therewith, and said switching member for said electrical switch; and screw means for securing said structural unit to a front surface of a shaft whereon the sheet-guiding drum is mounted.

6. Electrical circuit-breaking device according to claim 5 including an axial roller bearing mounted in an end face of said substantially bell-shaped housing, the actuating member, in said second travel phase thereof, being braced against said axial roller bearing.

7. Electrical circuit-breaking device according to claim 5, wherein said screw means include at least one screw passing loosely through a recess formed in said annular flange of said tension rod so as to secure said tension rod against rotation.

* * * * *